US006035584A

United States Patent [19]

Barreto

[11] Patent Number: 6,035,584

[45] Date of Patent: Mar. 14, 2000

[54] BUILDING SYSTEM USING REPLACEABLE INSULATED PANELS

[76] Inventor: Jaime A Barreto, 413 Bannockburn Ave., Temple Terrace, Fla. 33617

[21] Appl. No.: 09/058,008

[22] Filed: Apr. 9, 1998

[51] Int. Cl.[7] ..... E04B 7/16

[52] U.S. Cl. ..... 52/79.1; 52/262; 52/264; 52/270; 52/396.04; 52/588.1

[58] Field of Search ..... 52/585.1, 396.04, 52/262, 263, 264, 265, 267, 268, 269, 270, 296, 274, 588.1, 586.1, 92.3, 236.3, 792.1, 592.1, 309.9, 79.1, 90.1, 793.1, 793.3; 403/335, 337, 338

[56] References Cited

U.S. PATENT DOCUMENTS

| | | | |
|---|---|---|---|
| 960,207 | 5/1910 | Slater | 52/264 |
| 2,439,960 | 4/1948 | Auten | 52/90.1 |
| 3,077,703 | 2/1963 | Bergstrom | 52/396.04 |
| 3,491,499 | 1/1970 | Dyer | 52/396.04 |
| 3,605,350 | 9/1971 | Bowers | 52/274 X |
| 3,729,889 | 5/1973 | Baruzzini | 52/264 |
| 3,760,548 | 9/1973 | Sauer et al. | 52/592.1 |
| 4,052,829 | 10/1977 | Chapman | 52/274 X |
| 4,104,840 | 8/1978 | Heintz et al. | 52/588.1 X |
| 4,577,445 | 3/1986 | Price | 52/396.04 |
| 5,048,248 | 9/1991 | Ting | 52/309.9 |
| 5,167,098 | 12/1992 | Blackwelder | 52/263 X |
| 5,343,665 | 9/1994 | Palmersten | 52/586.1 X |
| 5,448,865 | 9/1995 | Palmersten | 52/588.1 X |
| 5,499,482 | 3/1996 | Goff | 52/265 X |
| 5,502,939 | 4/1996 | Zadok et al. | 52/592.1 X |
| 5,509,242 | 4/1996 | Rechsteiner et al. | 52/270 |
| 5,533,312 | 7/1996 | Mihalcheon | 52/396.04 X |
| 5,664,386 | 9/1997 | Palmersten | 52/586.1 X |
| 5,743,056 | 4/1998 | Balla-Goddard et al. | 52/309.11 |

*Primary Examiner*—Carl D. Friedman
*Assistant Examiner*—Phi Dieu Tran A

[57] ABSTRACT

A building system using replaceable insulated panels supported by a frame-work. The panels include mated side edges and fastened end edges to form sealed slipping joints. The wall panels are connected to a concrete floor or to floor panels at the base and to roof panels at the top. Both panels, the roof and the floor panels are fixed to the framework to receive and secure the wall panels. Also, the roof panels utilize edging reinforcement to prevent panel delamination and provide supports for installations. The framework is supported with concrete foundations or with movable footings for portable buildings. A combination of slipping joints, and fastening connections of panels to one another and to the framework provide for panel disengagement and replacement of individual panels.

4 Claims, 7 Drawing Sheets

BUILDING SYSTEM USING REPLACEABLE INSULATED PANELS

CROSS-REFERENCE TO RELATED APPLICATIONS not applicable

STATEMENT REGARDING FEDERALLY SPONSORED RESEARCH OR DEVELOPMENT not applicable

REFERENCE TO A MICROFICHE APPENDIX not applicable

BACKGROUND OF THE INVENTION

This invention relates in general to a building system using composite insulated panels and in particular to the interconnection system that facilitates panel replacement.

Building systems using composite panels fabricated with metal facing sheets separated by insulating cores with single or multiple layers of materials are well known in the art.

The following U.S. patents are among examples of the most related prior art and illustrate typical techniques for interconnecting prefabricated insulated building panels:

| U.S. Pat. No. | Inventor | Issue Date |
|---|---|---|
| 5,673,524 | Gailey | October 7, 1997 |
| 5,664,386 | Palmersten | September 9, 1997 |
| 5,613,338 | Eposito | March 25, 1997 |
| 5,509,242 | Rechsteiner et al. | April 23, 1996 |
| 5,502,939 | Zadok et al. | April 2, 1996 |
| 5,448,865 | Palmersten | September 12, 1995 |
| 5,404,686 | Eposito | April 11, 1995 |
| 5,293,728 | Christopher et al. | March 15, 1994 |
| 5,247,770 | Ting | September 28, 1993 |
| 5,086,599 | Meyerson | February 11, 1992 |
| 4,936,078 | Porter | June 26, 1990 |
| 4,295,304 | Kim | October 20, 1981 |
| 4,186,539 | Harmon et al. | February 5, 1980 |
| 4,123,885 | Scott | November 7, 1978 |

Inventors have been improving the prior art with specific regard to interlocking panel connections, structural safety, fire performance, weather sealing performance, appearance and easy erection.

Esposito in U.S. Pat. No. 5,613,338 issued Mar. 25, 1997 and U.S. Pat. No. 5,404,686 issued Apr. 11, 1995 and Porter in U.S. Pat. No. 4,936,078 issued Jun. 26, 1990 used sheets of fire resistant materials to improve the fire performance of the insulating cores.

Structural, thermal and weatherproof considerations have produced a variety of complex configurations that interlock panels. These configurations utilize the edges of facing sheets and their bonded core to form tongues or projections on one edge and pockets or cavities on the opposite edge. The completed interlocked panel joints include sealants or caulking compounds and are very difficult to disassemble.

U.S. Pat. No. 5,673,524 to Gailey, U.S. Pat. No. 5,664,386 to Palmersten, U.S. Pat. No. 5,613,338 to Esposito, U.S. Pat. No. 5,509,242 to Rechsteiner et al., U.S. Pat. No. 5,502,939 to Zadock et al., U.S. Pat. No. 5,448,865 to Palmersten, U.S. Pat. No. 5,247,770 to Ting and U.S. Pat. No. 5,086,599 to Meyerson are among the latest examples of complex interlocking configurations.

Some of the most common problems and disadvantages resulting from panel interlocking include:

Panel interlocking requires considerable force and panel disengagement is very difficult.

Damaged panels can be cut out and the openings prepared to receive a replacement. However, the main problem is to set the replacement in place. Commonly, insulated building panels interlock by pushing them together laterally or by an angular movement. But, the opening left by removing a damaged panel prevents installation of the interlocking replacement by either of these two methods.

Cutting the edges of the interlocking panels in order to install replacements will destroy their joint connections.

Sliding the replacements along their longitudinal edges into their final location is practically impossible.

Panels blocking access to the actual location of the panel being changed could be taken apart with great difficulty and reassembled. Nevertheless, this additional task is a major disadvantage.

A search of the prior art did not disclose any patents that included easy disassembly and replacement of composite insulated building panels. Therefore, there is a need for a building system that incorporates the improvements of composite insulated panels with simple connections that provide easy assembly, disassembly, reassembly and replacement of individual panels while retaining the integrity of the connection and the structural stability of the building.

BRIEF SUMMARY OF THE INVENTION

The principal object of the present invention is to provide a building system assembled from replaceable insulated panels supported by a framework.

This building system provides for engagement and securing of a plurality of panels eliminating interlocking joints and load bearing walls to facilitate assembly, disassembly, reassembly and replacement of individual panels.

The panels are made of cores bonded to facing sheets. The cores include materials to meet insulating requirements and the facing sheets include formed edges that comprise mated side edges and fastened end edges.

The main advantage of this building system is the combination of the panels mated side edges, fastened end edges and the connections to the frame-work which provide for simple disengagement and replacement of individual panels.

Another object is to provide detachable and simple connections of wall panels to concrete floor. These connections include border metal shelf angles to receive the replaceable wall panels.

Another object is to provide detachable and simple connections of replacement wall panels to replaceable floor panels. These connections include beveled panel ends to form fastened miter joints.

Another object is to provide detachable and simple connections of replaceable wall panels to replaceable roof panels. These connections include beveled panel ends to form fastened miter joints. Also, to provide connections of wall panels to roof panels with overhang.

Another object is to provide detachable and simple roof ridge connections. These connections include beveled panel ends and bent plates to form fastened miter joints.

Another object is to provide detachable roof panels to framework connections. These connections include roof panels fixed on edging supports that are fastened to the framework. The edging supports mechanically hold together top and bottom panel sheets to prevent delamination of panels at joints. Also, the edging supports facilitate suspension of lights, ducts, sprinklers and other installations.

Another object is to provide a building system utilizing individually replaceable insulated panels for walls and roof. The system comprising:

conventional concrete foundations;

conventional concrete ground floor;

conventional framework;

wall panels fastened to concrete floor and to roof panels;

roof panels fastened to framework with edging supports that are easy to connect and disconnect.

Another object is to provide a building system with portable components utilizing individually replaceable insulated panels for floor, walls and roof. The system comprising:

movable footings for the framework;

portable framework erected with components that are easy to connect and disconnect;

floor panels with reinforced edges fastened to the framework;

wall panels fastened to floor panels and to roof panels;

roof panels fastened to framework with edging supports that are easy to connect and disconnect.

The above summary and further objects, features, variations and advantages of the present invention will become apparent from the accompanying drawings and following detailed description of the invention.

DETAILED DESCRIPTION OF THE INVENTION

Figure 1:
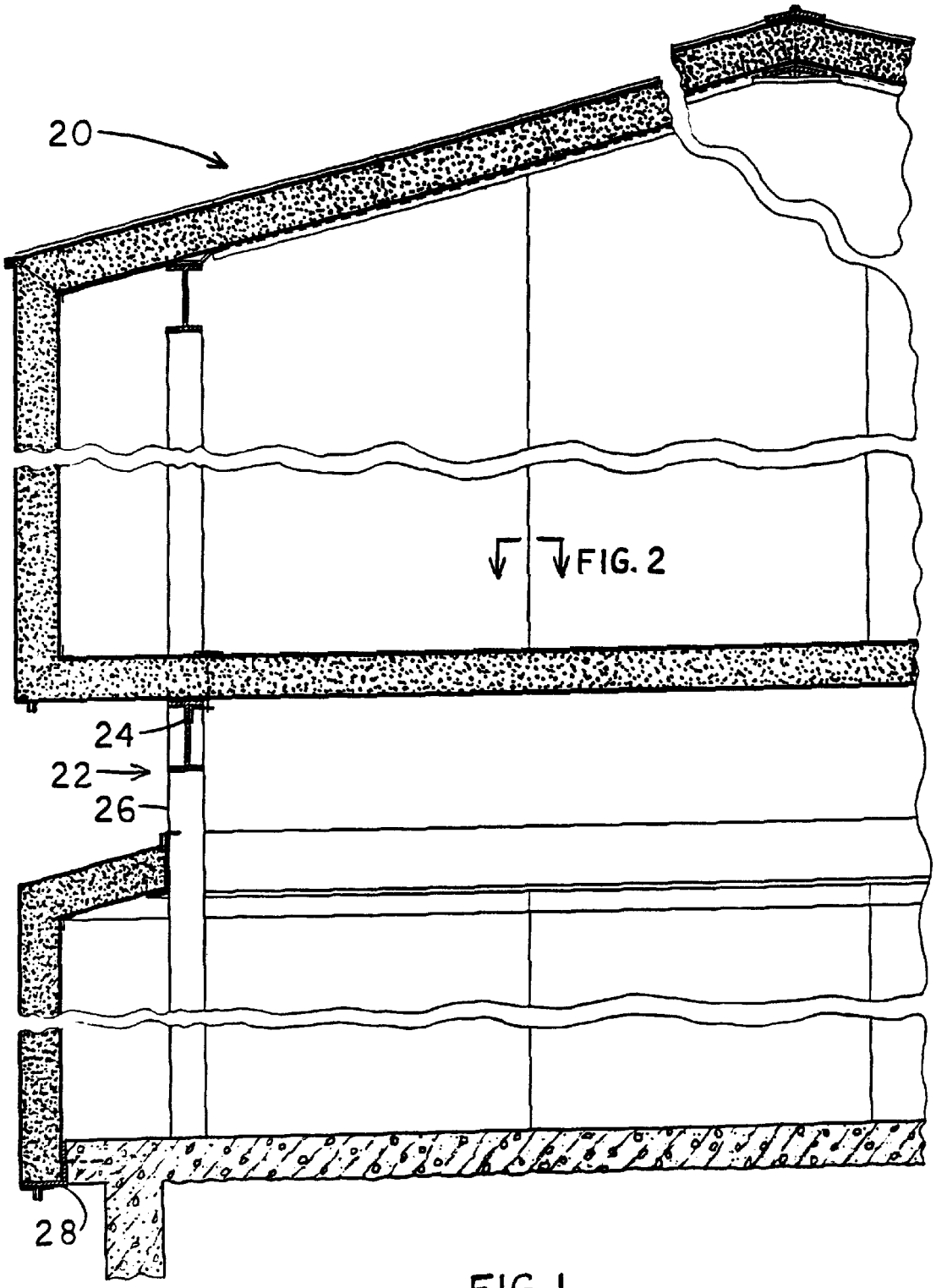
FIG. 1 is a partial cross section of a building arrangement showing the assembling connections of the building system of the present invention.

Refering to the drawings, FIG. 1 shows a vertical section of a building system using replaceable insulated panels.

The system illustrates typical connections of a building envelope 20 fastened to a conventional framework 22. Framework 22 includes beams 24 fastened to columns 26.

Envelope 20 is assembled with individually replaceable insulated panels comprising outwardly slipping side joints and complementary detachable end connections.

Conventional concrete foundations and floor are provided to receive the framework and envelope. The concrete floor includes a wall mounting metal border or shelf angle 28 to receive the replaceable wall panels.

The building system depicted in FIG. 1 integrates the panels including slipping side joints and complementary end connections with the framework in a two stories arrangement. Furthermore, the system is also applicable to portable buildings when the framework and envelope are connected directly to movable footings e.g., the upper part depicted in FIG. 1 fixed to portable foundations.

Figure 2:
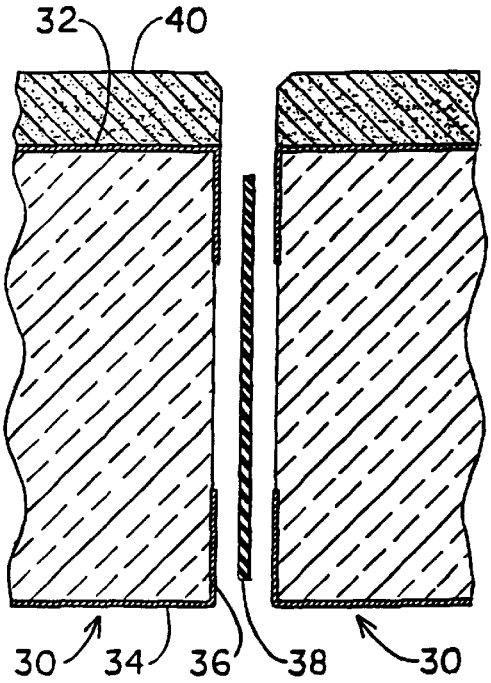
FIG. 2 is a sectional view through a slipping joint of the insulated panels indicated in FIG. 1.
Figure 3:
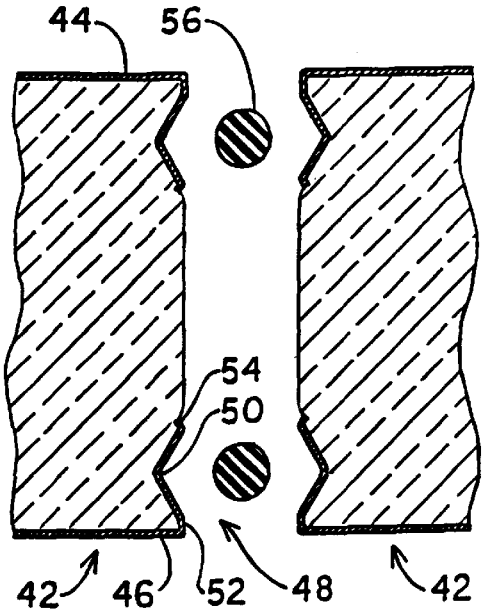
FIG. 3 is an alternative of the slipping joint shown in FIG. 2.
Figure 4:
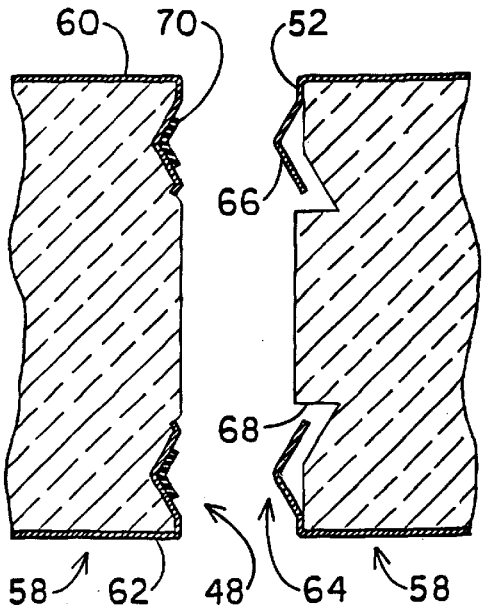
FIG. 4 is another alternative of the slipping joint shown in FIG. 2.

FIGS. 2, 3 and 4 show sectional views of side joints made with the interconnecting panels. The panels include formed side edges that provide direct mating engagement and independent disengagement to each individual panel.

In FIG. 2, panels 30 show their interior metal facing sheets 32 and exterior metal facing sheets 34 with extended side edges beyond the cores to form flanges 36. Flanges 36 are made by bending the extended metal side edges inwardly at right angles from the faces of the panels.

Insulating separators 38 are inserted between flanges 36 to close the joint for protection from moisture penetration, air leakage, temperature changes, manufacturing tolerances and misalignments.

Fire resistant wallboards 40 are attached to facing sheets 32 to improve fire resistant capability when fire resistant ratings are required.

Other wallboards may be attached to satisfy additional thermal acoustical or high-impact requirements.

In FIG. 3, panels 42 show their interior metal facing sheets 44 and exterior metal facing sheets 46 with extended side edges beyong the cores to form flanges 48. Flanges 48 are made by bending the extended metal side edges inwardly at right angles from the faces of the panels to form grooves 50 of v-shaped cross section. Grooves 50 being defined between outside butting border 52 and inside border 54 deflected into the panel core. Resilient gaskets or round tape sealers 56 are inserted between grooves 50 to weatherproof the joint and compensate for temperature changes, manufacture tolerances and misalignments.

In FIG. 4 panels 58 show their interior metal facing sheets 60 and exterior metal facing sheets 62 with extended side edges beyond the cores to form mating flanges 48 on one side and cantilevered flanges 64 on the opposite side. Flange 64 is made by bending the extended metal side edge inwardly at right angles from the face of the panels to form ridges 66, of v-shaped cross section. Ridges 66 including outside butting border 52 and inside border deflecting into the panel core. Deflections in cantilevered flange 64 result in a spring like effect during engagement or disengagement of panels 58. To facilitate these deflections, the panel core is provided with clearances around flange 64 or cutouts 68. Resilient sealing strips or tape sealers 70 are inserted in the joint between grove 50 and ridge 66 to increase weather sealing and compensate for temperature changes, manufacture tolerances and misalignments.

Figure 5:
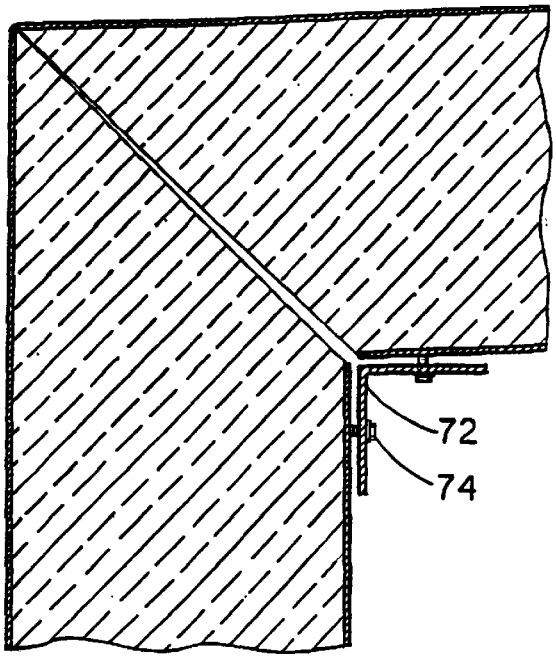
FIG. 5 is a cross section of a continuous panel corner.

FIG. 5 shows a cross section for a continuous panel corner. To make this vertical or horizontal corner, usually the interior facing sheet of the panel is cut to provide the inside corner, the panel core is beveled for a miter joint and the exterior facing sheet is bent to form the outside corner. To fix the joint, the inside corner is closed with angles 72 and fasteners 74.

Figure 6:
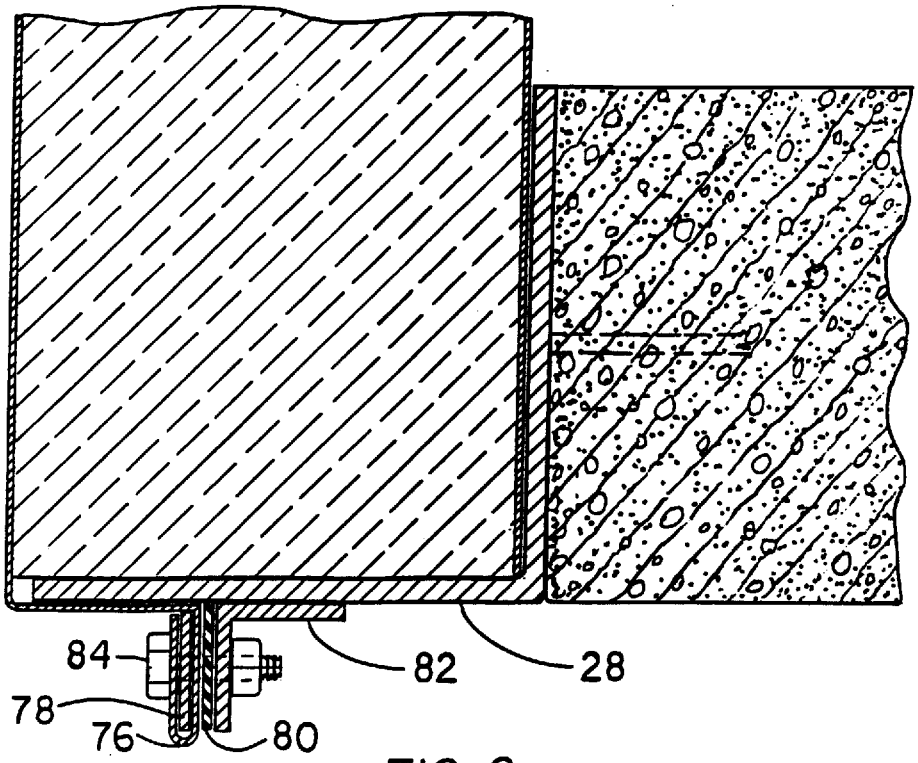
FIG. 6 is a vertical sectional view of the connection between concrete floor and wall panels.

FIG. 6 shows a connection between wall panels and shelf angle 28 which is anchored to a concrete floor. In this connection, the exterior facing sheets of the wall panels are bent at right angles from the face of the panels to form a recess for hemmed edges 76. These edges include hem bars 78 to prevent the facing sheets from tearing. To weatherproof the connection, tape sealer 80 is placed between hemmed edge 76 and receiving angle 82 which is attached to angle 28. To secure the panels at the base, edges 76 are fixed to angle 82 with fasteners 84.

Figure 7:
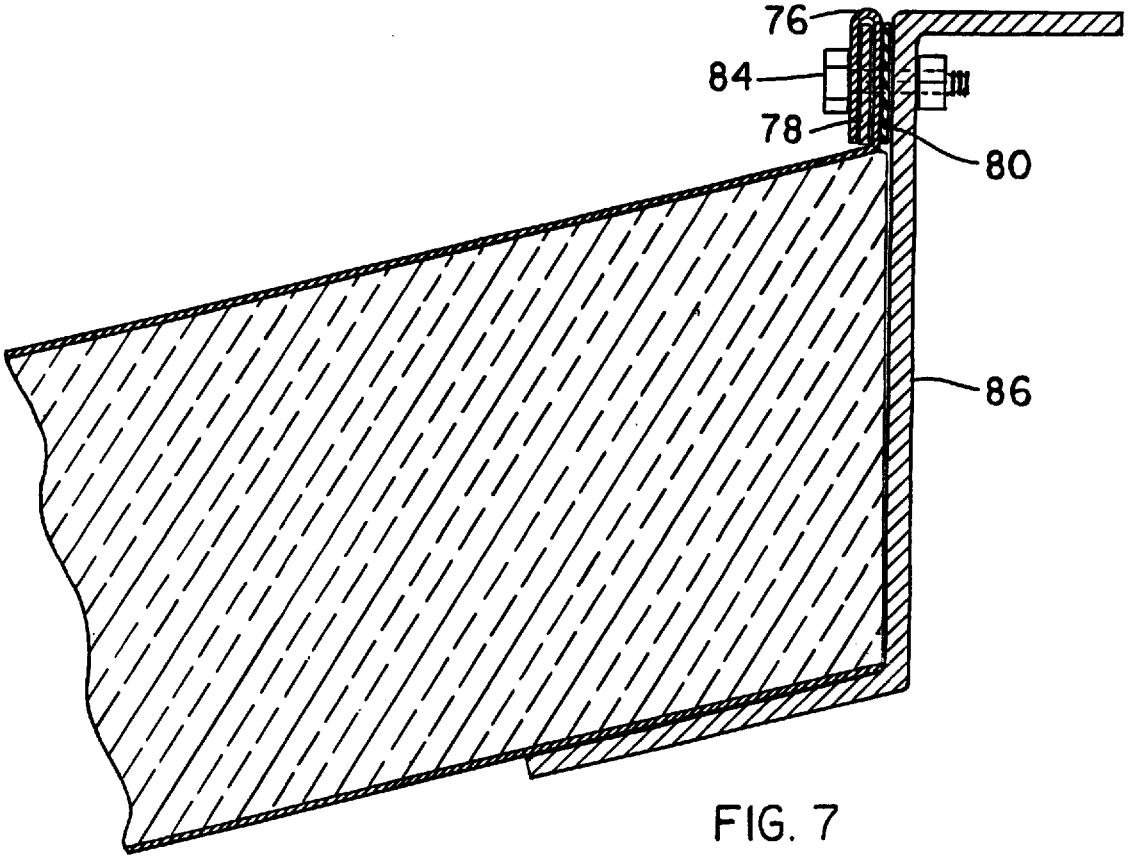
FIG. 7 is a vertical sectional view of the connection between panels and girt.

FIG. 7 shows a panel connection to bent plate or girt 86 which is attached to the framework. In this connection, the exterior facing sheet of the panel is provided with hemmed edge 76 and hem bar 78. To weatherproof the connection, tape sealer 80 is placed between hemmed edge 76 and girt 86. To secure the connection edge 76 is fixed to girt 86 with fasteners 84.

Figure 8:
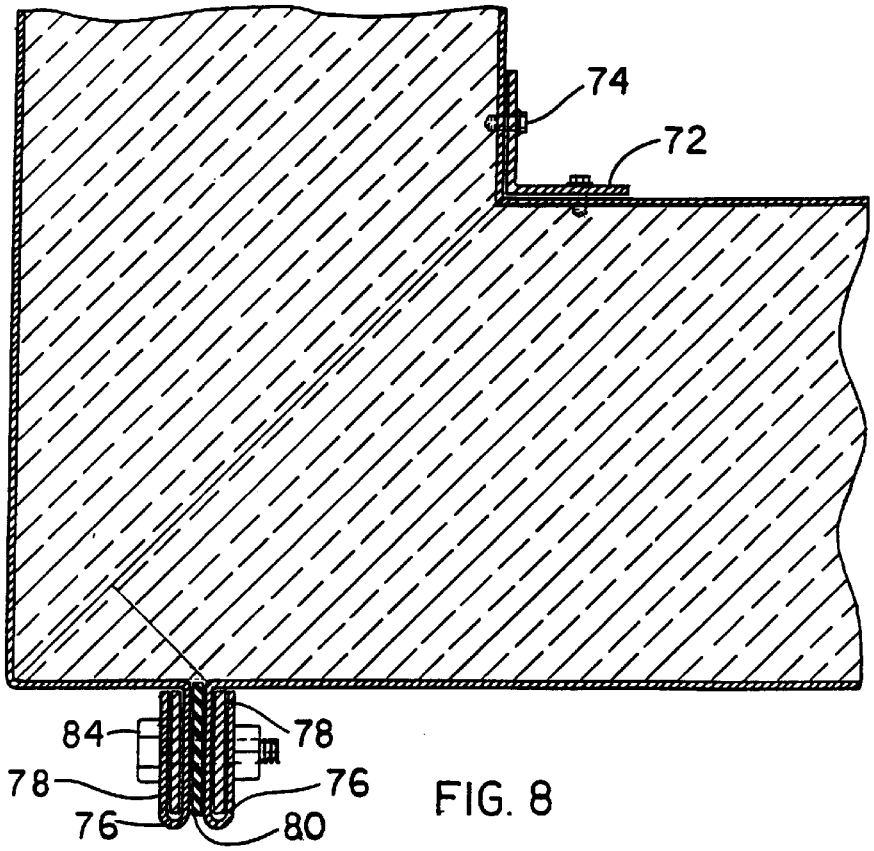
FIG. 8 is a vertical sectional view of the connection between floor panels and wall panels.

FIG. 8 shows a connection between floor panels and wall panels. To make this connection the core end of the panels is beveled for a miter joint and the exterior facing sheet of the wall panel is bent at right angle from the face of the panel to provide a recess for hemmed edge 76 and hem bar 78 which engage with hemmed edge 76 and hem bar 78 provided in the bottom facing sheet of the floor panel. The joint is weatherproof with tape sealer 80 placed between the two hemmed edges 76. To secure the connection, edges 76 are fixed to each other with fasteners 84 and the inside corner is closed with angles 72 and fasteners 74.

Figure 9:
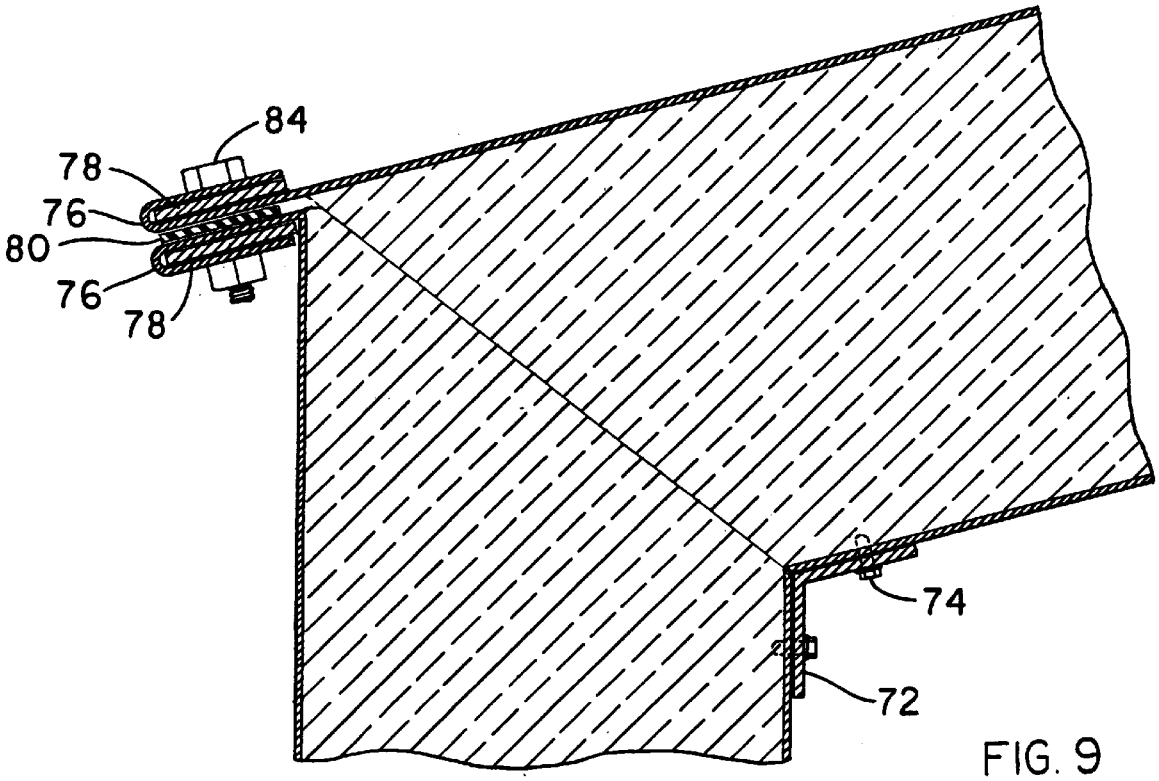
FIG. 9 is a vertical sectional view of the connection between wall panels and roof panels.

FIG. 9 shows a connection between wall and roof panels. To make this connection the core end of the panels is beveled for a miter joint and the exterior facing sheet of the wall panel is bent to provide hemmed edge 76 and hem bar 78 which engage with hemmed edge 76 and hem bar 78 provided in the top facing sheet of the roof panel. The joint is weatherproof with tape sealer 80 placed between the two hemmed edges 76. To secure the connection, edges 76 are fixed to each other with fasteners 84 and the inside corner is closed with angle 72 and fasteners 74.

Figure 10:
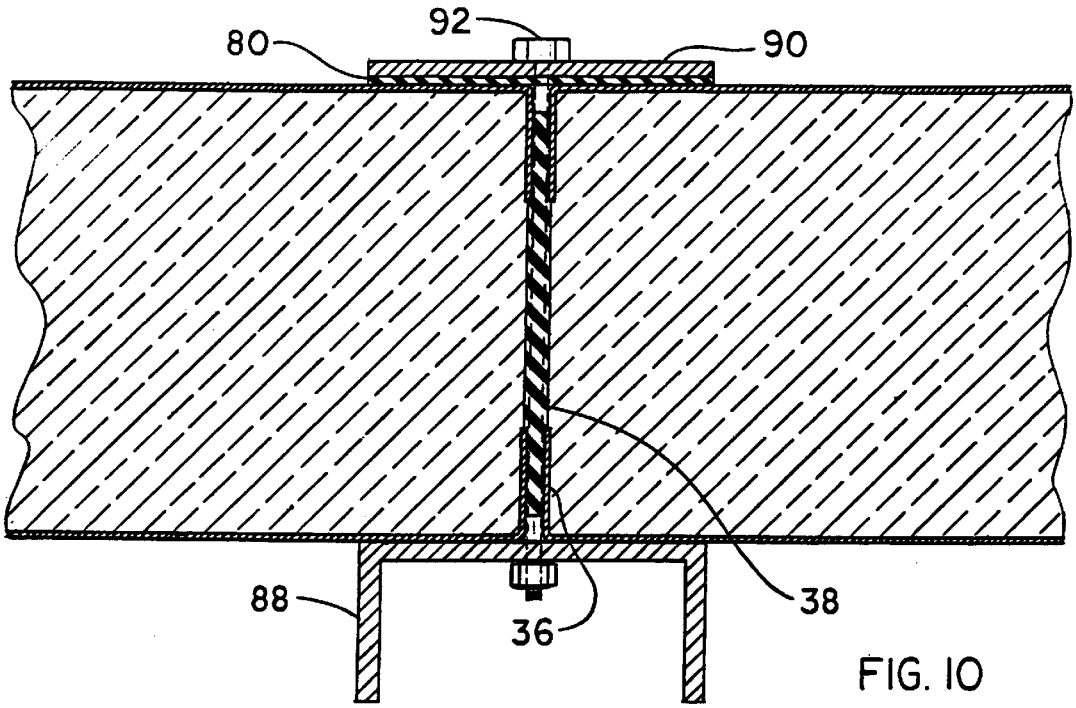
FIG. 10 is a sectional view through the side joint of interconnected roof panels.

FIG. 10 shows a side joint of interconnected roof panels. The joint includes panels with facing sheets having flanges 36, insulating separators 38 and edging supports composed of bottom chord 88 and top chord 90. The joint is weatherproof with tape sealer 80 placed between chord 90 and the panel edges. To secure the joint and provide supports for suspended installations,chords 88 and 90 are fixed to each other with fasteners 92.

Figure 11:
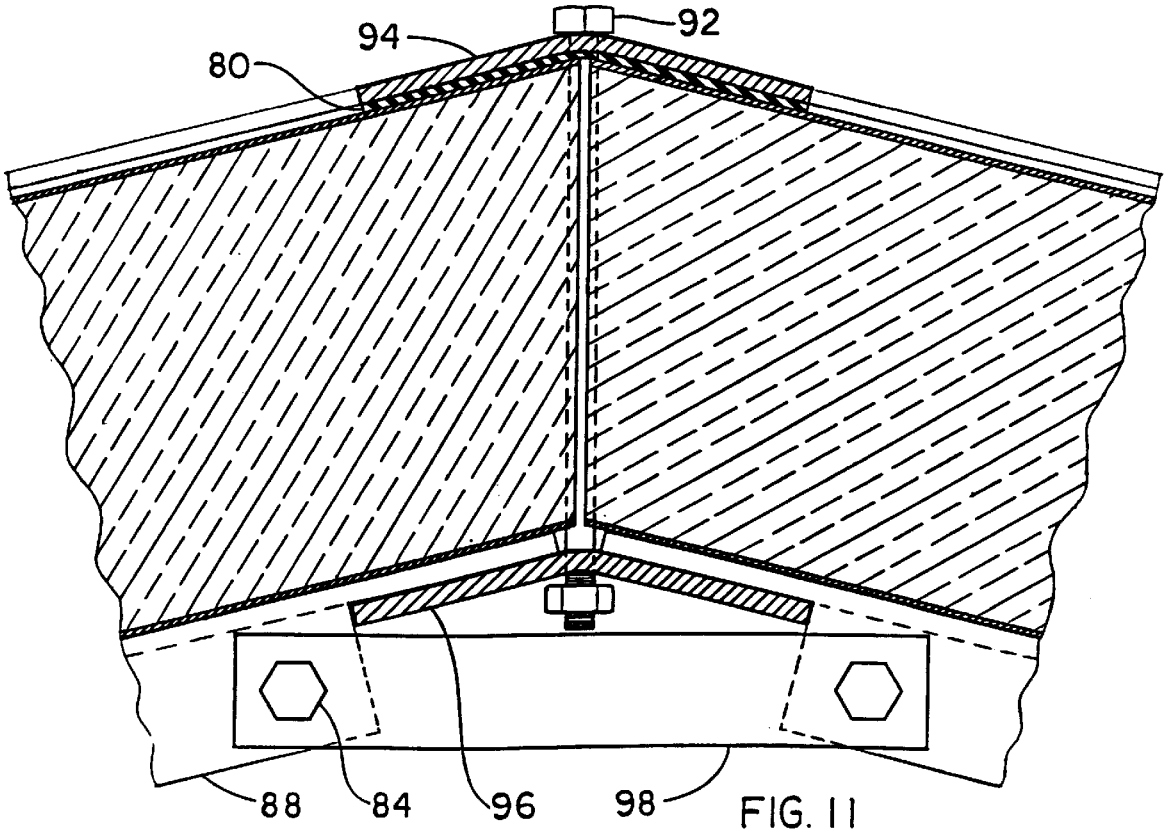
FIG. 11 is a vertical sectional view of the roof ridge connection.

FIG. 11 shows a roof ridge connection. To make this connection, the core end of the panels is beveled for a miter joint and the ridge support is composed of cap plate 94 and shelf plate 96 attached to the framework, chords 88 rest on plate 96 and are fixed to each other with connector 98 and fasteners 84. To weatherproof the connection tape sealer 80 is placed between the panels and plate 94. To secure the connection both plates 94 and 96 are fixed to each other with fasteners 92.

Figure 12:
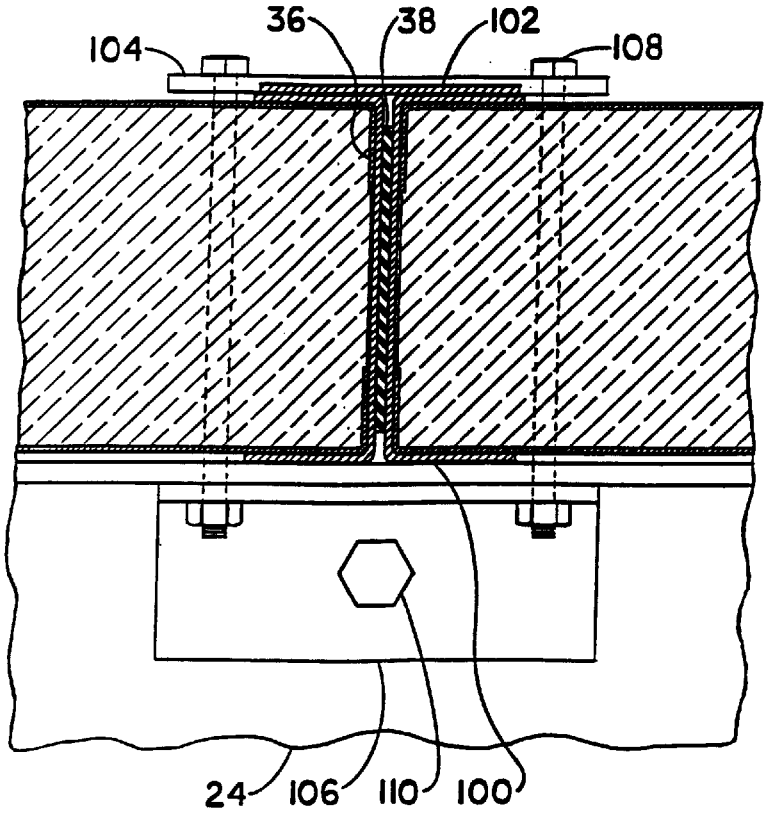
FIG. 12 is a vertical sectional view of the connection between floor panels and framework.
Figure 13:
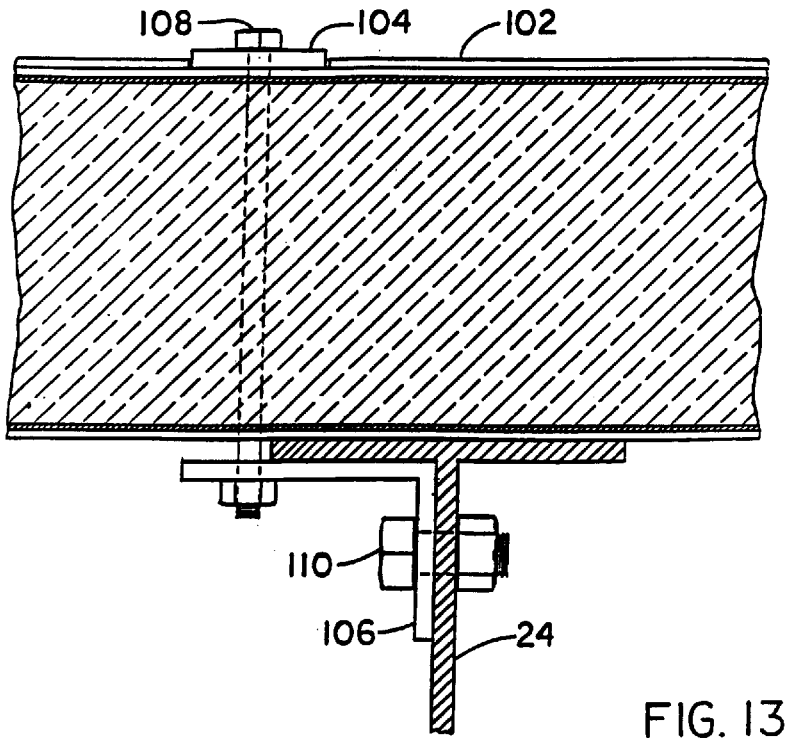
FIG. 13 is a side sectional view of FIG. 12.

FIGS. 12 and 13 show a connection between floor panels and framework. FIG. 13 being the side view of FIG. 12. To make this connection, the floor panels are provided with flanges 36 reinforced with channels 100, insulating separator 38 and cover strap 102 fastened to one side only. To secure the connection bearing plate 104 is fixed to clip angle 106 with fasteners 108 and angle 106 is attached to beam 24 with fasteners 110.

Figure 14:
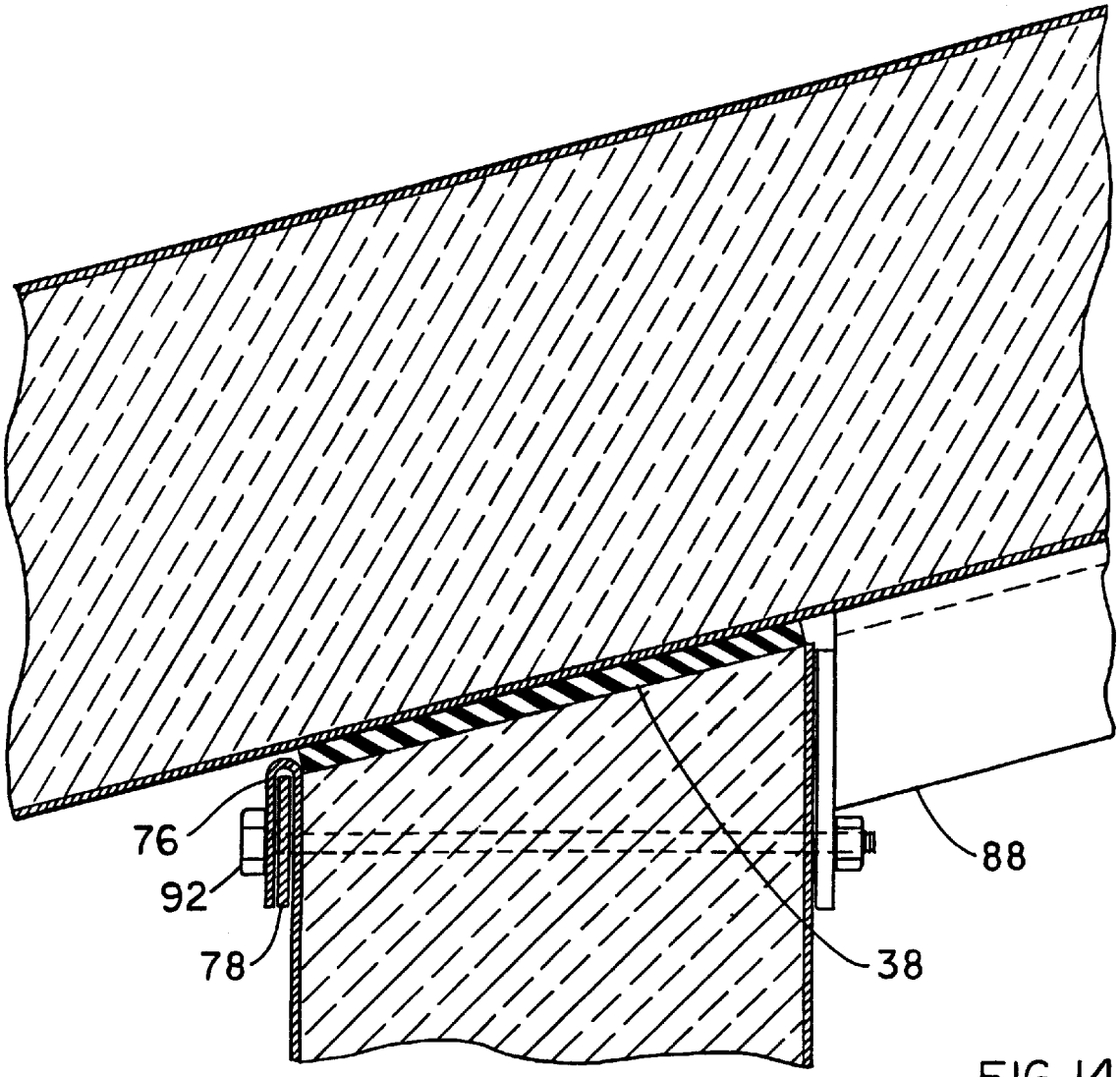
FIG. 14 is a vertical sectional view of the connection between wall and roof panels with overhang.

FIG. 14 shows a connection between wall panels and roof panels with overhang. To make this connection, the exterior facing sheet of the wall panels is bent to provide hemmed edge 76 and hem bar 78 and insulating separator 38 is placed between top of wall panels and roof panels. To secure the connection, edge 76 is fixed to bottom chords 88 with fasteners 92.

Figure 15:
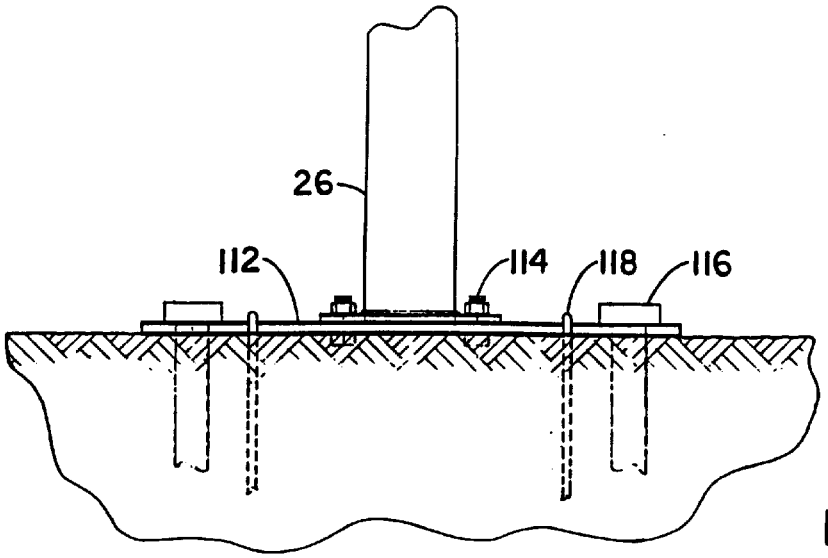
FIG. 15 is a sectional view of the connection between columns and portable foundations.

FIG. 15 shows a connection between framework and conventional portable foundations. In this connection, column 26 is fixed to foundation plate 112 with fasteners 114. Plate 112 is anchored to the ground with shear stakes 116 and ground anchors 118.

Refering again to FIG. 1, the application of the bulding system of the present invention is further described in two examples.

In the first example, construction of one story buildings with permanent foundations and floors may include the following components:

- framework fixed to concrete footings;
- concrete floor with shelf angle anchored to concrete as in FIG. 6;
- roof panels spanned between beams and cantilevered beyond the beams with side joints including edging supports as illustrated in FIG. 10. The roof ridge connection depicted in FIGS. 1 and 11 is optional;
- wall panels spanned between the shelf angle at the floor and the cantilevered ends of the roof panels as illustrated in FIGS. 6 and 9 or 14; and
- corner panels as illustrated in FIG. 5.

In the second example, construction of one story portable buildings may include the following components:

- framework supported with movable footings as illustrated in FIG. 15.
- floor panels spanned between beams and cantilevered beyond the beams with side joints including edging supports as illustrated in FIGS. 12 and 13;
- roof panels spanned between beams and cantilevered beyond the beams with side joints including edging supports as illustrated in FIG. 10;
- wall panels spanned between the cantilevered ends of the floor panels and the cantilevered ends of the roof panels as illustrated in FIGS. 6 and 9 or 14; and
- corner panels as illustrated in FIG. 5.

The method of construction requires assembly of the framework in order to proceed with the engagement of panels to each other and to the framework.

Installation of the individual building panels starts with the fastening of the central panel to work out any accumulated joint tolerances toward the sides of the building or corner panels. Then interconnecting the panels to complete floors, roofs and walls.

Refering again to FIGS. 2, 3 and 4, these outward slipping joints are made so that each individual panel can easily be replaced. In FIG. 2, the outward slipping results by moving the side flanges 36 over the flanges of the adjoining panels. In FIG. 3, the outward slipping results from rolling and deformation of the resilient round tape sealers 56 placed between grooves 50, and in FIG. 4, outward slipping results from deflections in the cantilevered flanges 64.

Elimination of load bearing walls and utilization of the panels outward slipping side flanges and their complementary detachable end connections facilitates individual replacement of panels.

Replacement of wall panels may start by unfastening bottom connections FIGS. 6 or 8 and top connections FIGS.

7, 9 or 14. Then, the panel is removed by outward slipping. To install the replacement, the new panel is slipped in position and fastened at the top as indicated in FIGS. 7, 9 or 14 and at the bottom as indicated in FIGS. 6 or 8.

Replacement of roof panels may start by unfastening the connection at the wall FIG. 9, by removing top chords 90 and tape sealer 80 indicated in FIG. 10 and by loosing cap plate 94 and tape sealer 80 indicated in FIG. 11. Then, the panel is removed by outward slipping. To install the replacement, the new panel is slipping in position, the panel joints are closed with the tape sealer and chords 90 are fastened as in FIG. 10 completing the operation by fixing plate 94 as in FIG. 11 and fastening the connection at the wall as in FIG. 9.

Replacement of floor panels may start by unfastening the connections at the wall panels FIG. 8 and at the framework FIGS. 12 and 13. To remove the floor panel, the wall panels are separated at the floor to clear the ends of the floor panel. This separation is facilitated by loosing the connection at the top of the wall panels FIGS. 9 or 14. To install the replacement, the new panel is slipped in position and fastened to the framework as indicated in FIGS. 12 and 13 and to the wall panels as indicated in FIG. 8.

Doors and windows may be installed in a conventional manner, either as an integral part of the panels or their frames may be attached directly to the framework.

The above description shall not be construed as limiting the ways in which this invention may be practiced but shall be inclusive of many other variations that do not depart from the broad interest and intent of the invention.

What is claimed is:

1. A building system assembled from individually replaceable insulated panels supported by a separate and conventional framework, the system comprising:

a plurality of composite panels made to be joined edge to edge to form continuous insulated walls, roof and floor;

each panel having a laminated insulating core bonded to an exterior facing sheet and an interior facing sheet;

said facing sheets having extended mating side edges and extended fastening end edges to form panel to panel sealed joints;

said side and end edges having integral flanges formed to provide slipping perpendicular to the face of abutting panels;

said perpendicular slipping provides for individual and random replacement of panels after completion of said walls, roof and floor;

a wall panel to floor connection having the exterior facing sheet of said wall panel extended to define a bottom corner which expands to form an integral and recessed open hem for fastening said wall panel to a concealed shelf angle fixed to said floor;

a wall to roof panel connection having the exterior facing sheet of said wall panel extended to form an integral folded open hem fastening to a folded open hem formed by the extended edge of the top facing sheet of said roof panel; and a combination of said mating, fastening and installation means whereby said building system provides for individual and random replacement of panels after completing the installation of all panels in said building system;

said extended side edges of the interior facing sheets being bent at right angles to form integral flanges perpendicular to the face of abutting panels;

said integral and perpendicular flanges having a central V-shaped inward groove defined between an outside butting border and an inside border being deflected into the panel core;

said borders having relative equal widths;

a resilient round tape sealer of predetermined size being inserted between said central V-shaped inward grooves;

said round tape being capable of rolling and deforming to provide slipping perpendicular to the face of abutting panels; and said perpendicular slipping provides for individual and random replacement of panels after completion of said building system.

2. The building system according to claim 1 wherein said wall panel to floor connection is further comprising:

said exterior facing sheet of said wall panel having a clockwise folded open hem;

a tape sealer placed between said hem and a fastening angle attached to said concealed shelf angle; and said outside corner having fastened hemmed edges;

said inside corner being secured with angle and fasteners; and said connection allowing for replacement of individual panels.

3. The building system according to claim 1 wherein said wall panel to roof panel connection is further comprising:

said exterior facing sheet of said wall panel having a counterclockwise folded open hem;

said top facing sheet of said roof panel having a clockwise folded open hem;

a tape sealer placed between the two hemmed edges;

the inside facing sheets of said wall and roof panels secured to each other independent of outside conductivity for thermal separation; and said wall panel to roof panel connection providing for individual and random replacement of installed panels.

4. The building system according to claim 1 wherein said roof panels further comprise:

said roof panels having longitudinal and transverse side edges;

said transverse side edges being adapted to be fixed to said conventional framework;

said longitudinal side edges having integral folded open hems;

said open hems folded outwardly and formed even with the exterior face of adjacent panels to provide concealed butting borders;

said butting borders having joints slipping perpendicular to the face of said adjacent panels;

a separated open hem having its folded sides inserted in sealant contained in said open hems of said concealed butting borders;

said folded sides of all hems having relative equal depths; and said perpendicular slipping joints to provide for individual and random replacement of panels after completing installation of all panels in said building system.

* * * * *